US009644421B2

(12) United States Patent
Langkamp

(10) Patent No.: US 9,644,421 B2
(45) Date of Patent: May 9, 2017

(54) ROLLING SHUTTER WITH DAMPING BODY

(71) Applicant: Hörmann KG Dissen, Dissen (DE)

(72) Inventor: Thomas Langkamp, Georgsmarienhütte (DE)

(73) Assignee: HORMANN KG DISSEN, Dissen (DE)

( * ) Notice: Subject to any disclaimer, the term of this patent is extended or adjusted under 35 U.S.C. 154(b) by 0 days.

(21) Appl. No.: 14/848,496

(22) Filed: Sep. 9, 2015

(65) Prior Publication Data

US 2016/0076301 A1 Mar. 17, 2016

(30) Foreign Application Priority Data

Sep. 11, 2014 (DE) ..... 20 2014 104 290 U
Oct. 28, 2014 (DE) ..... 10 2014 115 672

(51) Int. Cl.

| | |
|---|---|
| ***E06B 9/08*** | (2006.01) |
| ***E06B 9/17*** | (2006.01) |
| ***E06B 9/15*** | (2006.01) |
| ***E05D 15/24*** | (2006.01) |
| ***E06B 5/20*** | (2006.01) |
| ***E06B 9/58*** | (2006.01) |

(52) U.S. Cl.

CPC ..... *E06B 9/17076* (2013.01); *E05D 15/24* (2013.01); *E06B 5/20* (2013.01); *E06B 9/08* (2013.01); *E06B 9/15* (2013.01); *E06B 9/58* (2013.01); *E06B 2009/587* (2013.01)

(58) Field of Classification Search

CPC ..... E06B 9/17076; E06B 5/20; E06B 9/08; E06B 9/11; E06B 9/13; E06B 2009/135; E06B 9/15; E06B 2009/1505; E06B 2009/1511; E06B 2009/17069

USPC ..... 160/120, 121.1, 98, 133, 104, 107, 264

See application file for complete search history.

(56) References Cited

U.S. PATENT DOCUMENTS 4,436,136 A * 3/1984 Downey, Jr. ..... E06B 3/485 160/232
4,630,664 A * 12/1986 Magro ..... E06B 9/15 160/232

(Continued)

FOREIGN PATENT DOCUMENTS

DE 89 07 445 U1 10/1989
DE 197 11 318 A1 11/1997

(Continued)

OTHER PUBLICATIONS

Evreux. English Translation of "DE19711318" Jun. 11, 1997. <https://worldwide.espacenet.com/>.*

(Continued)

*Primary Examiner* — Katherine Mitchell
*Assistant Examiner* — Johnnie A Shablack
(74) *Attorney, Agent, or Firm* — Global IP Counselors, LLP

(57) ABSTRACT

A rolling shutter comprises a winding shaft having a rolling shutter curtain formed from metallic premade rolling shutter curtain bars. The rolling shutter curtain is configured to be wound up on the winding shaft into a winding bale, and comprises a set of damping bodies. The damping bodies are formed from a synthetic foam material, an elastomer material, and/or a textile material. The damping bodies can be detachably mounted to the rolling shutter curtain bars.

10 Claims, 4 Drawing Sheets

(56) References Cited

U.S. PATENT DOCUMENTS 4,723,588 A * 2/1988 Ruppel ..... E06B 9/165 160/235
5,307,859 A * 5/1994 Kraeutler ..... E06B 9/13 160/264
5,343,922 A * 9/1994 Rankl ..... E06B 9/15 160/133
5,419,386 A * 5/1995 Magro ..... E06B 9/15 160/232
5,482,104 A * 1/1996 Lichy ..... E06B 9/13 160/273.1
6,065,525 A * 5/2000 Wells ..... E06B 9/58 160/273.1
6,883,577 B2 * 4/2005 Frede ..... E06B 9/56 160/133
7,111,661 B2 * 9/2006 Laugenbach ..... E06B 9/13 160/133
7,328,613 B2 * 2/2008 Volkel ..... E06B 9/15 160/232
7,581,773 B2 * 9/2009 Strasser ..... B60R 7/04 160/183
8,109,316 B2 * 2/2012 Wang ..... A62C 2/10 160/232
8,590,244 B2 * 11/2013 O'Riordan ..... E06B 3/485 160/229.1
8,684,064 B2 * 4/2014 Frede ..... E06B 9/17076 160/133
8,851,147 B2 * 10/2014 Drifka ..... E06B 9/13 160/268.1
2003/0047291 A1 * 3/2003 Klein ..... E06B 9/15 160/133
2004/0163777 A1 * 8/2004 Frede ..... E06B 9/56 160/268.1
2006/0196617 A1 * 9/2006 Barkman ..... E06B 9/386 160/236
2010/0326606 A1 * 12/2010 Barkman ..... E06B 9/386 160/188
2011/0265959 A1 * 11/2011 Frede ..... E06B 9/17076 160/133
2013/0147223 A1 * 6/2013 Zoehrens ..... B60J 1/20 296/37.8
2016/0076301 A1 * 3/2016 Langkamp ..... E06B 3/485 160/133
2016/0090777 A1 * 3/2016 Brunton ..... E06B 9/582 160/133

FOREIGN PATENT DOCUMENTS

DE 10 2010 022 172 B3 7/2011
WO 2009/148460 A1 12/2009

OTHER PUBLICATIONS

Rubber Cal "Foam Sponge Rubber." Aug. 16, 2014. <http://www.rubbercal.com/industrial-rubber/foam-sponge-rubber/>.*
Saint-Gobain "Foam Tapes." 2001. <http://www.foams.saint-gobain.com/uploadedFiles/SGfoams/Documents/FoamTape.pdf>.*

* cited by examiner

ROLLING SHUTTER WITH DAMPING BODY

CROSS-REFERENCE TO RELATED APPLICATIONS

This application claims priority under 35 U.S.C. §119(a) to German Patent Application No. 10 2014 104 290.3, filed on Sep. 11, 2014, and to a German Patent Application No. 10 2014 115 672.2, filed on Oct. 28, 2014, the entire contents of German Patent Application Nos. 10 2014 104 290.3 and 10 2014 115 672.2 are hereby incorporated herein by reference.

BACKGROUND

Field of the Invention

The invention relates to a rolling shutter and, in particular, to a damping body for a rolling shutter.

Background Information

A rolling shutter having a winding shaft and a rolling shutter curtain is disclosed in DE 10 2010 022 172 B3. The rolling shutter curtain is formed by double walled rolling shutter curtain bars which can be wound up on the winding shaft into a winding bale. The rolling shutter curtain bars are composed of a metal half shell and a synthetic half shell and serve as sound insulation and heat protection. Protrusions are inseparably formed to the synthetic half shell, in order to reduce rattling noise.

Also, DE 197 11 318 A1 describes a roller blind for doors and windows. The slats of the curtain are made from synthetic material and cause clicking noises during winding up and winding down. Blocks attached to the slats increase static friction, thereby preventing a relative movement of slats laying on top of each other.

Furthermore, DE 89 07 445 U1 discloses a sound-insulated aluminum hollow profile bar. The hollow profile bar is coated with a noise-reducing layer of varnish. In addition, WO 2009/148460 A1 relates to high speed action doors, with a rolling shutter curtain is provided with damping elements at the side hinges, and U.S. 2004/0163777 A1 discloses a high speed action door having lateral wind-up elements that comprise a sound insulating material and allow the rolling shutter curtain to be wound up spirally.

During winding up the rolling shutter curtain bars which are getting put on top of each other cause noise. Also the rolling shutter curtain surface can be abraded. The above-mentioned rolling shutter are provided with noise-reducing means. In practice, however, numerous rolling shutter are installed which do not have any noise-reducing means. Retrofitting with the above-mentioned means requires for the most part a complete disassembly of the rolling shutter or even the manufacturing of a new rolling shutter curtain. This is cumbersome and expensive.

SUMMARY

The invention is based on the object to improve rolling shutter with respect to noise emission and abrasion behavior. In particular, the invention relates to a rolling shutter with a winding shaft having a rolling shutter curtain formed from metallic prefabricated rolling shutter curtain bars, the rolling shutter curtain being configured to get wound up on the winding shaft into a winding bale, and with a set of damping bodies formed from a synthetic foam material, an elastomer material, and/or a textile material, such that the damping bodies are detachably mountable to the rolling shutter curtain bars.

At least one and preferably all damping bodies can comprise an adhesive surface for adhesively bonding to a first rolling shutter curtain bar. At least one and preferably all damping bodies can comprise a contact surface for contacting a second rolling shutter curtain bar. Also, at least one and preferably all damping bodies are configured to contact only one single second rolling door curtain bar, when in a wound up state, and at least one and preferably all damping bodies are adhesively bonded to one of the rolling shutter curtain bars.

In addition, at least one and preferably all damping bodies are configured as

- a foam pad made from a foam material; and/or
- a polymer foam body made from a foamed polymer material; and/or
- an elastomer foam body made from a foamed elastomer material; and/or
- an elastomer body made from an elastomer material; and/or
- a textile fiber body made from textile fiber.

Furthermore, at least one and preferably all damping bodies are disposed on a rolling shutter curtain winding side, preferably on an inner side, which gets wound up facing the winding shaft, when being wound up. At least two and preferably all damping bodies can be adjacently disposed along the vertical direction, and at least two and preferably all damping bodies have no displacement with respect to the horizontal direction. The damping bodies can be disposed on all rolling shutter curtain bars, and at least one and preferably all damping bodies are disposed on the rolling shutter curtain winding side, preferably on an inner side, which gets wound up facing the winding shaft, when being wound up.

The invention further provides a damping body for a previously described rolling shutter having a fastener for detachably adhesively fastening the damping body, as well as a set of damping bodies for a previously described rolling shutter having a fastener for detachably adhesively fastening the damping body.

The damping body has any of the previous described configurations, and a set of the damping bodies can be used for reducing operational noise of a rolling shutter. An elastic element is an example for a damping body. For instance, elastic elements made from synthetic foam can be attached to the curtain of the rolling shutter in such a way that their elastic behavior generates a damping effect when the rolling shutter profiles are put on top of each other.

As understood in the art, when the profile bars of a rolling shutter are wound up one after another and on top of each other, the profile bars can generate noise and cause abrasion on the curtain or profile surface. However, with the embodiments described herein, the energy of the profile bars being stacked is damped it while maintaining the same curtain velocity. The reduced impact energy reduces the generation of noise and prevents the surfaces of the stacking rolling shutter profile bars from being damaged. The embodiments described herein have advantages such as their applicability to rolling shutters already in operation, individual/targeted mountability to, for example, only the profiles under the most strain, the comparably easy residue-free removal of the elements, and the effects on the rolling shutter itself, thereby indirectly allowing a possible performance increase by allowing for an increase of rotational speed, an increase of service life, and so on.

The elements to be mounted on or at the rolling shutter curtain have an elastic/spring-elastic behavior. The height of the elements is chosen in such a way that a damping behavior can be generated as soon as possible and at the same time the diameter of the winding bale and thereby the rolling shutter dynamic is not impaired too much. The elements are preferably individually adhesively fastened to the rolling shutter profile, and can act on any rolling shutter profile individually. The elements can be removed again, and can also be used as a retrofitting solution for third party products. For example, foam pads which can function as elastic elements can be glued to a pre-existing rolling shutter profile to achieve improved sound insulation with retrofitting capability.

In addition, an influence on the wind stability is reduced or at least minimized. Thus, a reduction of the operational noise as a whole can be achieved. Furthermore, as described above, the buffering is carried out by elastomer materials, foam materials and/or textile fibers on the hall side of the curtain, for example. Thus, coating of the profiles of the curtain can be avoided. Also, the rolling shutter profiles are supported/damped on a visible inner side.

DESCRIPTION OF THE DRAWINGS

An exemplary embodiment of the invention is described with reference to the Figures listed below.

DETAILED DESCRIPTION OF EMBODIMENTS

Figure 1:
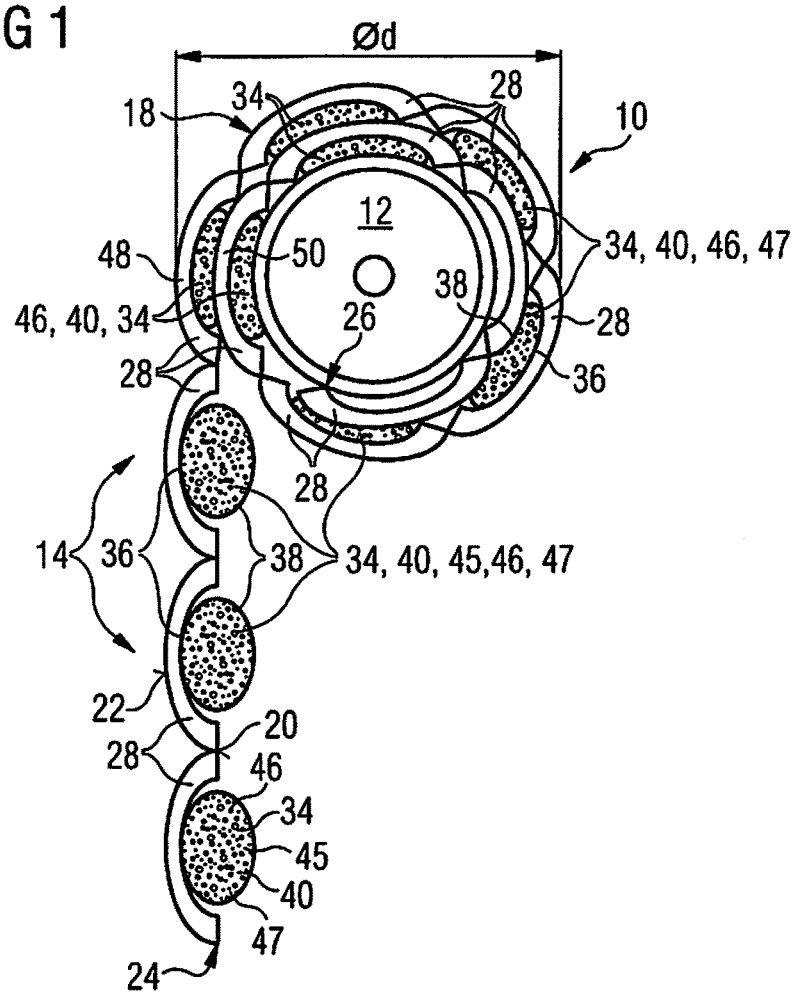
FIG. 1 depicts a schematic view of an exemplary embodiment of a rolling shutter door.
Figure 2:
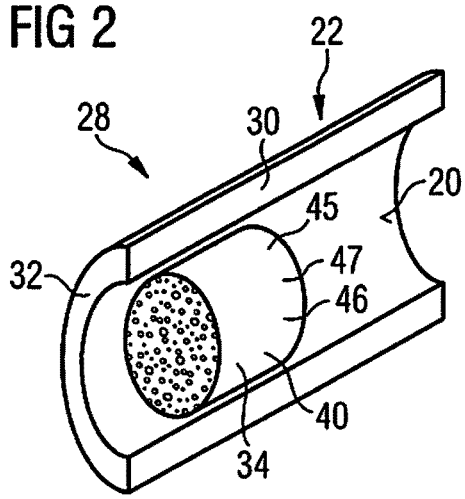
FIG. 2 depicts a view of an exemplary embodiment of a rolling shutter curtain.
Figure 3:
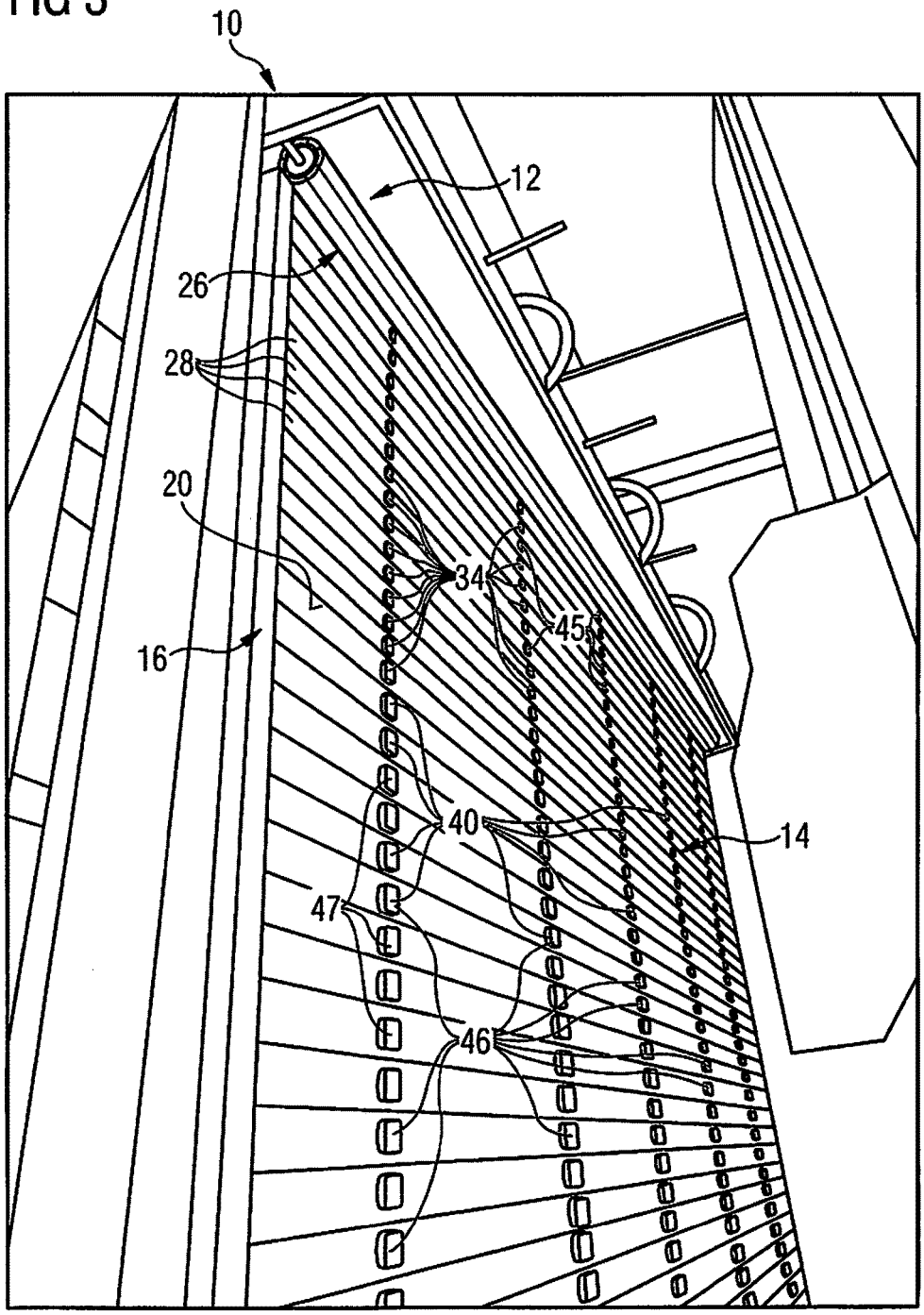
FIG. 3 illustrates another view of the rolling shutter of FIG. 1.
Figure 4:
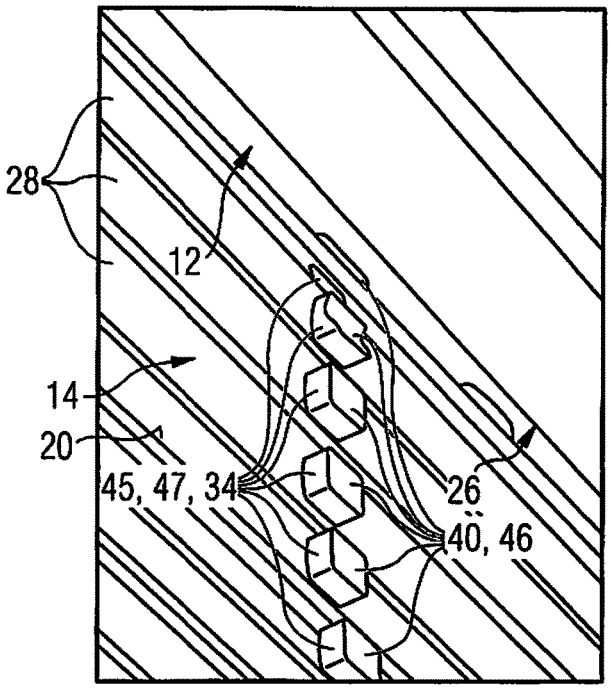
FIG. 4 shows an enlarged partial view of the rolling shutter of FIG. 3.
Figure 5:
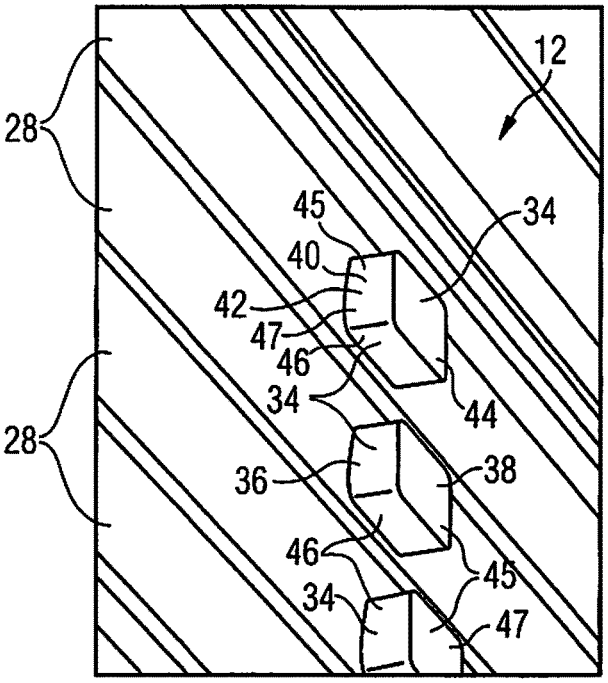
FIG. 5 depicts an enlarged view of the rolling shutter of FIG. 3.
Figure 6:
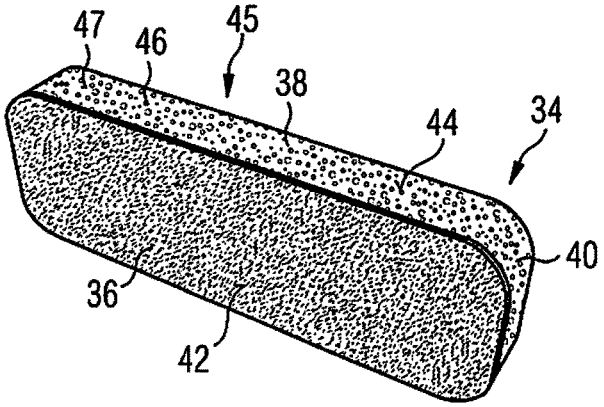
FIG. 6 illustrates an exemplary embodiment of a damping body.
Figure 7:
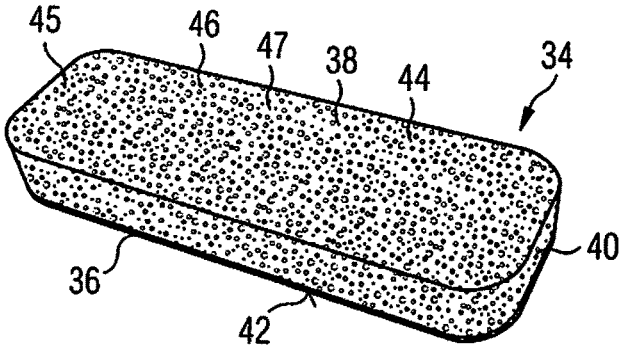
FIG. 7 shows another view of the damping body of FIG. 6.
Figure 8:
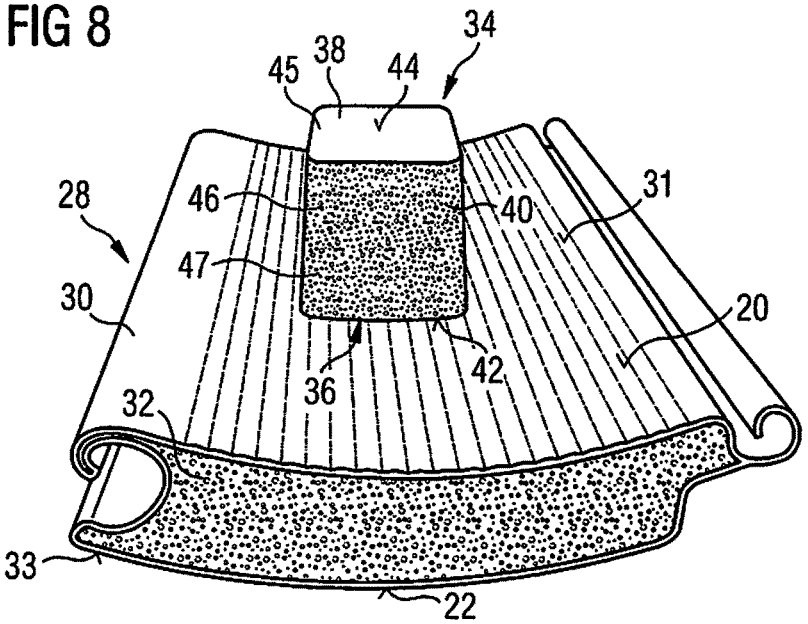
FIG. 8 illustrates a view of the damping body in a mounted state.

As shown, for example, in FIGS. 1 through 8, a rolling shutter 10 comprises a winding shaft 12 and a rolling shutter curtain 14. The rolling shutter curtain 14 is guided within a rolling shutter curtain guiding rail 16. The rolling shutter curtain gets wound up on the winding shaft 12 into a winding bale 18 in order to open the rolling shutter 10. The winding bale 18 has a winding bale diameter d in the wound-up state.

The rolling shutter curtain 14 comprises a rolling shutter curtain winding side 20, a rolling shutter curtain outer side 22, a rolling shutter curtain closing edge 24 and a rolling shutter curtain winding shaft side 26. The rolling shutter curtain winding side 20 is the side of the rolling shutter curtain 14 which during winding up gets wound up facing the winding shaft 12. The rolling shutter curtain outer side 22 is disposed on the opposite side of the rolling shutter curtain winding side 20. The rolling shutter curtain closing edge 24 is defined by the lowermost edge of the rolling shutter curtain 14. The rolling shutter curtain winding shaft side 26 is disposed opposite the rolling shutter curtain closing edge 24 at the uppermost edge at the winding shaft 12.

The rolling shutter curtain 14 is composed of rolling shutter curtain bars 28. The rolling shutter curtain bars 28 are hinged to each other. The rolling shutter curtain bars 28 are formed from a metallic rolling shutter curtain hollow profile 30 and a rolling shutter curtain hollow profile foaming 32. The rolling shutter curtain hollow profile 30 has a concave curved concave side 31 and convex curved convex side 33 opposing each other.

It is also possible that rolling shutter curtain profiles instead of rolling shutter curtain hollow profiles 30 are used for the rolling shutter curtain bars 28. The rolling shutter curtain profile can also be configured in a curved manner like the rolling shutter curtain hollow profile 30. It is also conceivable that the rolling shutter curtain hollow profile 30 or the rolling shutter curtain profile have a substantially rectangular or boxlike profile.

Damping bodies 34 are provided on the rolling shutter curtain winding side 20. The damping body 34 comprises fasteners 36 and contacting means 38. The fasteners 36 are configured to fasten the damping body 34 to the rolling shutter curtain winding side 20. The contacting means 38 are configured to contact the rolling shutter curtain outer side 22. The damping body 34 in one example is formed from a synthetic foam body 40 which is elastically deformable and made of a synthetic foam material. Other applicable materials include elastomer material and/or textile fibers. The synthetic foam body 40 comprises an adhesive surface 42 and a contact surface 44.

The adhesive surface 42 serves to adhesively bond the synthetic foam body 40 to the rolling shutter curtain bar 28. The adhesive surface 42 is configured in such a manner, that it is possible to remove the synthetic foam body 40 without substantial residue. The contact surface 44 is configured to engage a rolling shutter curtain bar 28, when the rolling shutter curtain 14 gets wound up onto the winding shaft 12. The synthetic foam body 40 is configured as a polymer foam body 45 made from a foamed polymer material and in particular as an elastomer foam body 46 made from a foamed elastomer material. The elastomer foam body 46 is in particular a cuboid foam pad 47 made from a foam material.

In the assembled state, the damping body 34 is fastened to a first rolling shutter curtain bar 48 by the fasteners 36. During winding up, the contacting means 38 contact a second rolling shutter curtain bar 50. In an exemplary embodiment, a damping body 34 is configured and arranged on the first rolling shutter curtain bar 48 in such a way that, when in a wound-up state, the contacting means 38 contact exactly one second rolling shutter curtain bar 50. In another exemplary embodiment, the contacting means 38 contact the hinge portion between two adjacent rolling shutter curtain bars 48.

In one exemplary embodiment, the damping bodies 34 are provided on every rolling shutter curtain bar 28. The damping bodies 34 are disposed adjacently in the vertical direction. The damping bodies 34 have no displacement in the horizontal direction. In a modification, the damping bodies 34 are disposed in five vertical rows without any horizontal displacement adjacently to each other on the rolling shutter curtain winding side 20.

Furthermore, the damping bodies 34 are configured in such a way that the winding bale diameters d, including the damping bodies 34, is minimally or not even greater than a winding bale diameter d' without the damping bodies 34.

This can be achieved using a suitable height of the damping bodies and/or a suitable arrangement on the rolling shutter curtain 14. The damping bodies 34 unfold a damping effect due to their elastic behavior during the stacking of single rolling shutter curtain bars 28, thereby reducing noise generation and abrasion phenomena. Pre-existing rolling shutters can easily be retrofitted with the damping bodies 34.

For manufacturing a rolling shutter 10, a set of damping bodies 34 is fastened, in particular glued, to the rolling shutter curtain winding side 20, which gets wound up facing the winding shaft 12 during winding up, of the rolling shutter curtain 14 installed for designated use. Presently, this side is the inner side of a building, for example a hall. According to an embodiment, the rolling shutter 10 is a rolling shutter door for industrial proposes.

What is claimed is:

1. A rolling shutter comprising:

a winding shaft having a rolling shutter curtain formed from metallic prefabricated rolling shutter curtain bars, each configured to include a respective recess, the rolling shutter curtain being configured to wind up on the winding shaft into a winding bale; and a plurality of damping bodies detachably mountable to the rolling shutter curtain bars within the respective recess of each of the rolling shutter curtain bars, each of the damping bodies comprising a synthetic foam material and being configured to compress to allow adjacent roller shutter curtain bars to contact each other when the roller shutter curtain is in a wound up state, and at least one of the damping bodies comprising a contact surface extending out of the respective recess and configured to contact a second rolling shutter curtain bar of the rolling shutter curtain bars, the contact surface being configured to contact only the second rolling door curtain bar when the roller shutter curtain is in the wound up state.

2. The rolling shutter according to claim 1, wherein at least one of the damping bodies comprises an adhesive surface configured to adhesively bond to a first rolling shutter curtain bar of the rolling shutter curtain bars.

3. The rolling shutter according to claim 2, wherein at least one of the damping bodies is disposed on a rolling shutter curtain winding side which is wound up facing the winding shaft when the roller shutter curtain is being wound up.

4. The rolling shutter according to claim 2, wherein at least two of the damping bodies are adjacently disposed along a vertical direction.

5. The rolling shutter according to claim 1, wherein at least one of the damping bodies is disposed on a rolling shutter curtain winding side which is wound up facing the winding shaft when the roller shutter curtain is being wound up.

6. The rolling shutter according to claim 5, wherein at least two of the damping bodies are adjacently disposed along a vertical direction.

7. The rolling shutter according to claim 1, wherein at least two of the damping bodies are adjacently disposed along a vertical direction.

8. The rolling shutter according claim 1, wherein the damping bodies are disposed on all of the rolling shutter curtain bars, with at least one damping body being disposed on a rolling shutter curtain winding side which is wound up facing the winding shaft when the roller shutter curtain is being wound up.

9. A plurality of damping bodies for a rolling shutter that includes a winding shaft having a rolling shutter curtain that is formed from metallic prefabricated rolling shutter curtain bars, each configured to include a respective recess, and the rolling shutter curtain being configured to wind up on the winding shaft into a winding bale, each of the plurality of damping bodies comprising:

a synthetic foam material, configured to compress to allow adjacent roller shutter curtain bars to contact each other when the roller shutter curtain is in a wound up state; and a fastener configured to detachably adhesively fasten the damping body to a respective one of the rolling shutter curtain bars within the respective recess of the respective one of the rolling shutter curtain bars; and at least one of the damping bodies comprising a contact surface extending out of the respective recess and configured to contact a second rolling shutter curtain bar of the rolling shutter curtain bars, the contact surface being configured to contact only the second rolling door curtain bar when the roller shutter curtain is in the wound up state.

10. A method for reducing operational noise of a rolling shutter by using the plurality of damping bodies according to claim 9, the method comprising:

fastening with the fastener respective groups of the plurality of damping bodies to respective ones of the rolling shutter curtain bars within the respective recess of each of the respective ones of the rolling shutter curtain bars.

* * * * *